United States Patent [19]

Russell

[11] Patent Number: 4,605,029

[45] Date of Patent: Aug. 12, 1986

[54] SELF SUPPORTING OUTDOOR SLEEPING SYSTEM

[76] Inventor: Chesley G. Russell, 11003 Meadow Rue, The Woodlands, Tex. 77380

[21] Appl. No.: 586,746

[22] Filed: Mar. 6, 1984

[51] Int. Cl.[4] ..... E04H 15/40; E04H 15/44; E47C 29/00; A41B 00/00

[52] U.S. Cl. ..... 135/104; 135/106; 135/95; 5/413; 2/69.5

[58] Field of Search ..... 5/420, 414, 413, 419; 2/69.5; 135/95, 101, 102, 104–106, 116

[56] References Cited

U.S. PATENT DOCUMENTS

| | | | |
|---|---|---|---|
| 23,582 | 4/1859 | Johns | 135/95 X |
| 730,877 | 6/1903 | Clapham | 5/413 X |
| 1,156,200 | 10/1915 | Ashworth | 5/121 |
| 1,583,419 | 5/1926 | Perl | 2/69.5 |
| 1,919,154 | 7/1933 | Astrove | 5/413 X |
| 2,358,410 | 9/1944 | Matthesius | 5/413 X |
| 3,474,802 | 10/1969 | Loring | 135/104 |
| 3,751,741 | 8/1973 | Hendry | 5/416 |
| 3,800,814 | 4/1974 | Hippert | 135/95 X |
| 3,971,495 | 7/1976 | Velazquez | 135/95 X |
| 4,072,158 | 2/1978 | O'Brien et al. | 135/120 X |
| 4,078,572 | 3/1978 | Moss | 135/105 X |
| 4,183,111 | 1/1980 | Zahavkochav | 5/413 |
| 4,236,543 | 12/1980 | Moss | 135/105 X |

FOREIGN PATENT DOCUMENTS

| | | | |
|---|---|---|---|
| EP31860 | 7/1981 | European Pat. Off. | 2/69.5 |
| 2446622 | 9/1980 | France | 5/413 |
| 2454775 | 12/1980 | France | 135/904 |
| 2481589 | 11/1981 | France | 135/904 |
| 610743 | 5/1979 | Switzerland | 52/2 |
| 1581786 | 12/1980 | United Kingdom | 135/904 |

*Primary Examiner*—Robert A. Hafer
*Assistant Examiner*—D. Neal Muir
*Attorney, Agent, or Firm*—Gunn, Lee & Jackson

[57] ABSTRACT

An outdoor sleeping system incorporating a ground engaging sheet having a pocket connected thereto within which is disposed a pad to provide comfort for the user especially in rough terrain. The ground contacting sheet incorporates a pair of slide fastener strips, the innermost of which receives a thermal liner of suitable weight to protect the user under low temperature conditions. To the outermost slide fastener strip is secured a tent or bivy cover which is maintained erect by flexible ribs. The tent is provided with an enlarged hood, having a rain flap and insect excluding ventilators permitting the user to control the temperature of the enclosure from within. The sleeping system is completely self-supporting and for portability may be rolled to a cylindrical form and secured with straps. The sleeping system may also take a double-wide form for use by two persons.

24 Claims, 12 Drawing Figures

FIG. 4
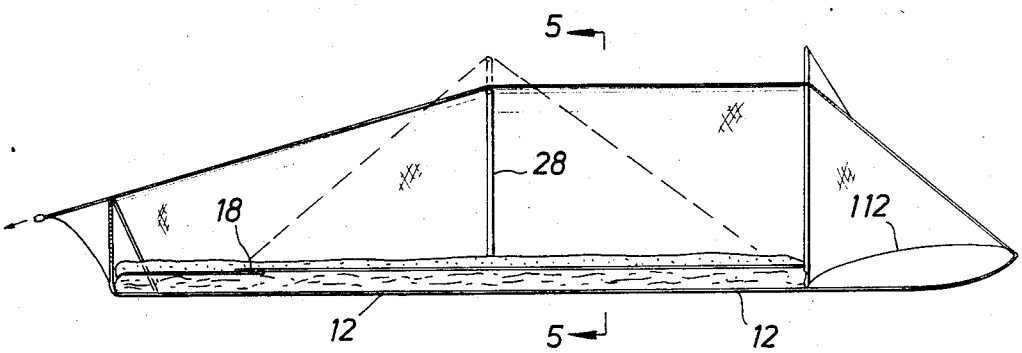
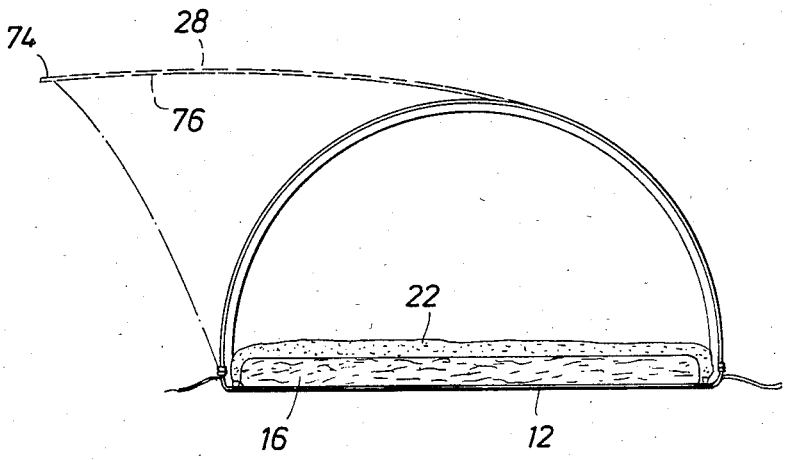
FIG. 5
FIG. 6
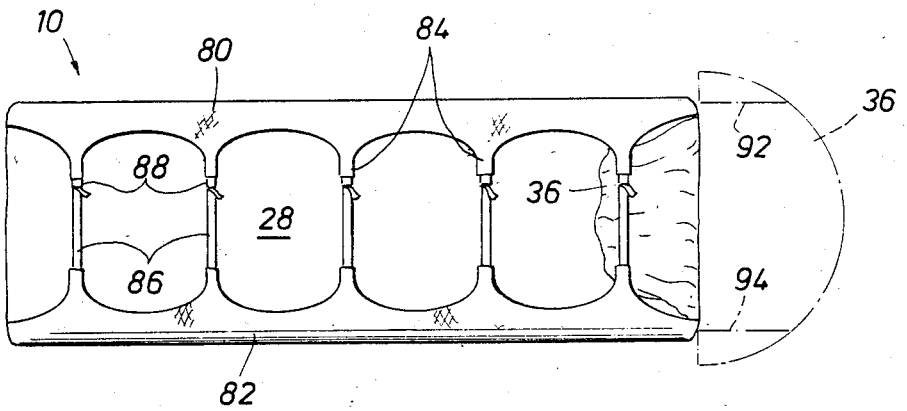
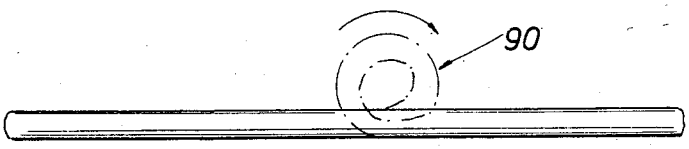
FIG. 7

FIG. 8
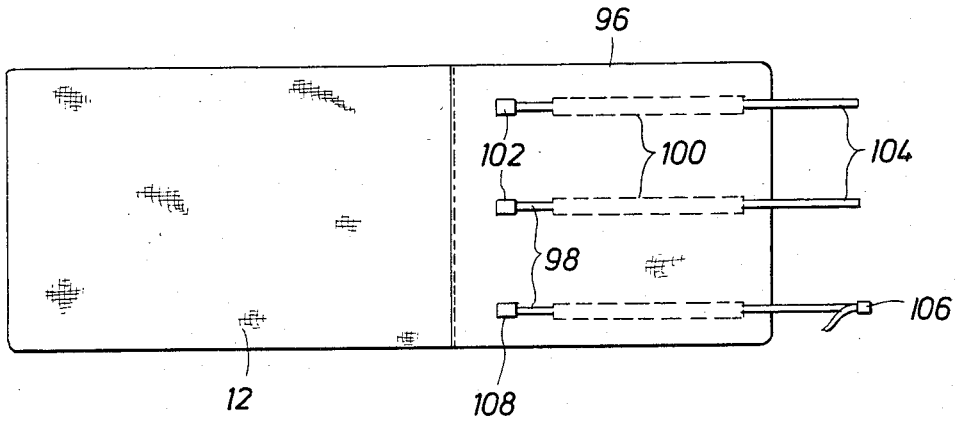
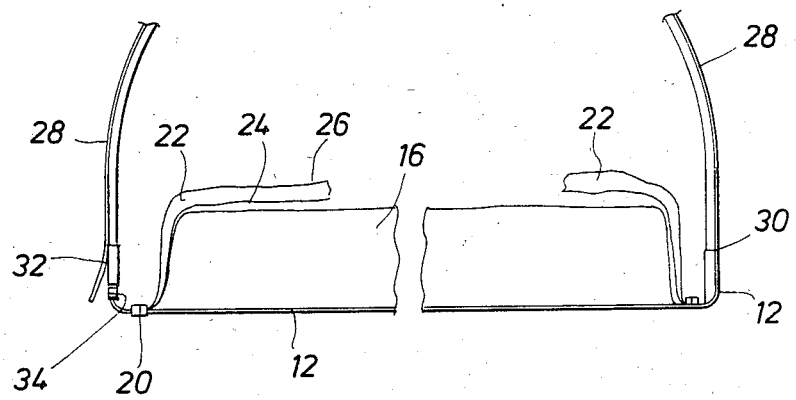
FIG. 9
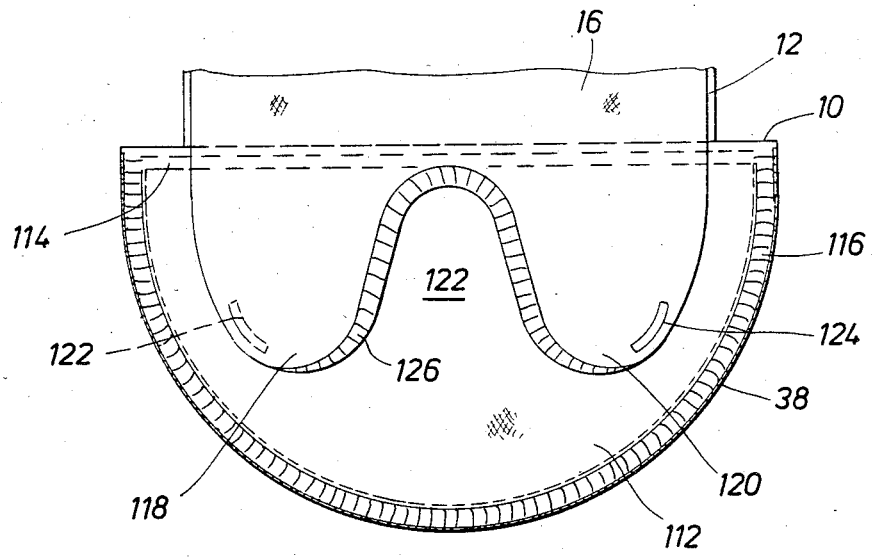
FIG. 10

FIG. 11
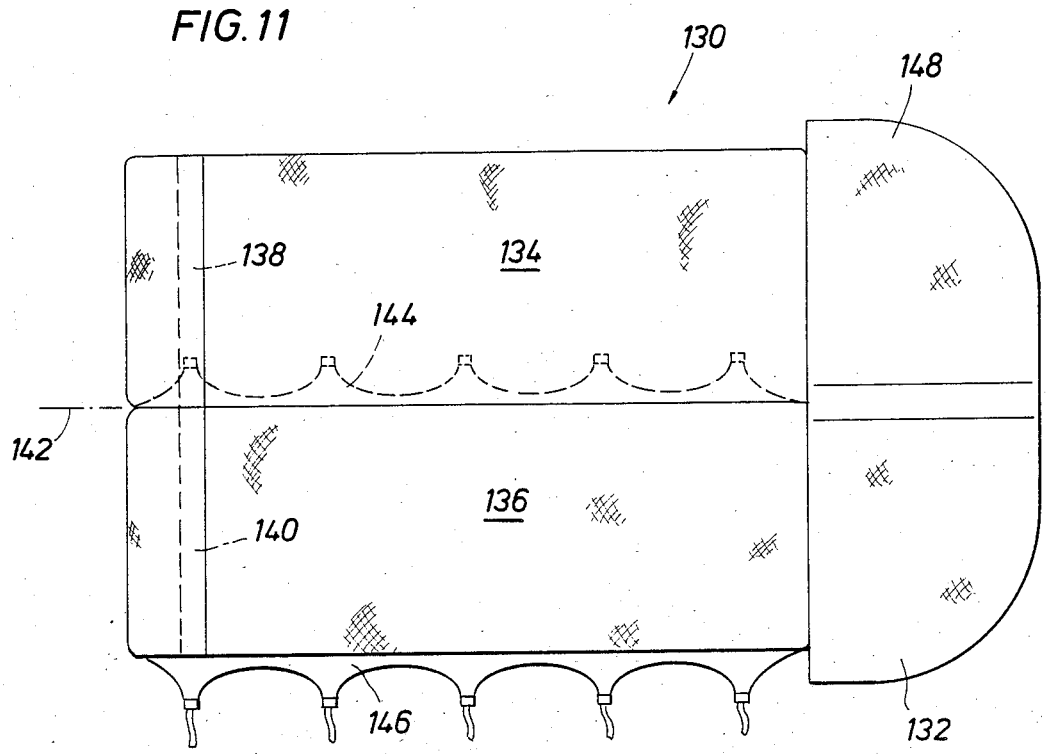
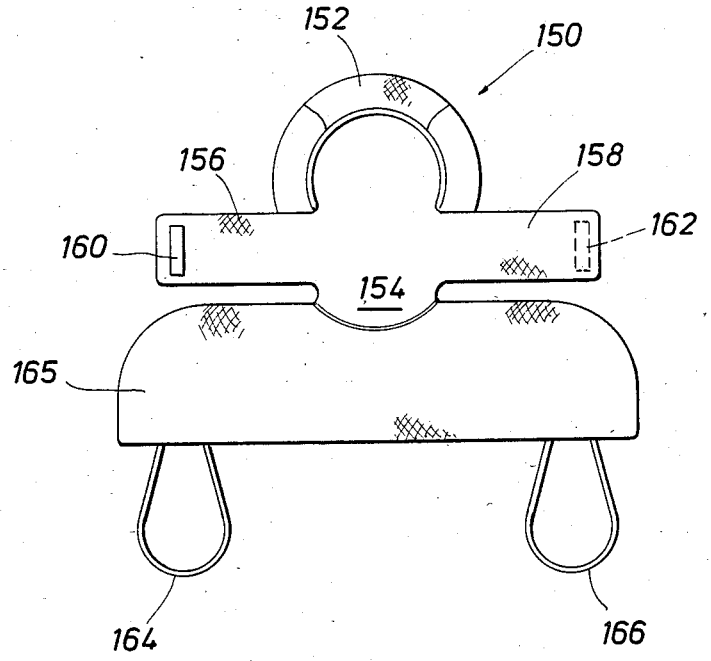
FIG. 12

SELF SUPPORTING OUTDOOR SLEEPING SYSTEM

FIELD OF THE INVENTION

This invention relates generally to outdoor sleeping equipment such as tents, sleeping bags, sleeping supports, etc., and more specifically concerns a sleeping system for use by one or two persons and which includes a protective ground cover, protective support pad, temperature control liner and a protective cover or tent enabling the user to remain comfortable in a wide variety of environmental conditions.

BACKGROUND OF THE INVENTION

A large number of people enjoy outdoor sports such as hiking, backpacking, camping, hunting and fishing, etc., where extended periods of time are spent in an outdoor environment, being subjected to a wide variety of environmental conditions. In many cases, tents and other types of portable shelters are utilized to provide comfort and protection from the effects of certain environmental conditions. In many cases where outdoor activities are enjoyed in remote locations, the equipment involved is desired to be sufficiently light and portable that it can be transported by the user such as by means of a backpack, pack animal, etc. It is to such lightweight and portable camping and sleeping facilities that the present invention is directed.

SUMMARY OF THE INVENTION

Briefly, a protective sleeping system according to this invention takes the form of a combination mattress sleeping bag and tent or bivy cover that provides efficient protection and comfort in a wide variety of outdoor conditions. Further, the system is of extremely lightweight nature and may be efficiently rolled to a very small size to enable its portability such as for backpacking activities, etc. The sleeping system incorporates a ground cover sheet which is impervious to moisture. The ground cover sheet incorporates a protective casing panel having a connector means such as a plurality of straps connected thereto. When rolled to a small size, the protective casing panel forms an outer protective layer for the sleeping system and the connector means or straps completely encircle the rolled sleeping system to thus secure it in rolled condition.

To the ground cover sheet is secured a fabric pad pocket of a generally rectangular shape, having an overlapping fabric opening at one end thereof to enable a rectangular mattress pad to be inserted into the pocket. The pad provides a protective cushion to thus render the sleeping system comfortable to the user even under use in fairly rough terrain.

For further protection and comfort of the user, the sleeping system incorporates a peripheral slide fastener strip which is secured to the ground cover sheet and provides for attachment of a thermal liner about the rectangular pad. The liner is used for a thermal cover by the user and may be of any suitable weight and thermal character to provide ample protection for the user in the range of temperature conditions that are to be expected. The thermal liner is provided with spaced extensions at the head end thereof enabling it to be wrapped or connected snugly about the head of the user to minimize body heat loss. Also secured to the ground cover sheet is a tent or bivy cover structure. The tent is connected at one side and along the opposite side and head portions of the ground cover sheet by means of a slide fastener connection. This feature allows the side and end of the tent or bivy cover to be released from the ground cover sheet to enable it to flex to an open condition along the side portion to thus enable the user to have more efficient lateral access for ingress or egress. In its open condition, the flexible rib elements maintain the tent cover taut even though it is released from the ground cover sheet along its side portion. This enables the tent to shed rain and enables the user to enter and exit the tent from the side without permitting the liner and pad structure to get wet by falling rain.

The sleeping system is provided with an enlarged hood portion at the head portion thereof which includes vent means, the effective size of which can be efficiently controlled by the user to facilitate as much ventilation as is desired. The enlarged head portion of the sleeping system is also provided with protective flaps which prevent rain from entering the vent openings and also assists in maintaining the taut self supporting condition of the tent structure.

The head portion of the sleeping system is also provided with an insect cover and a portective flap which are both secured to the ground cover sheet by means of slide fasteners. This feature enables the head portion of the tent to be completely open when desired for adequate ventilation and warm conditions. The head cover flap provides protection against rain. The head portion of the ground cover sheet is provided with a pocket into which may be stuffed clothing, thermal liners, etc., to thus form a pillow for the reclining comfort of the user.

Also for the comfort of the user under extremely cold conditions, a thermal head and shoulder cover device is employed which incorporates straps that pass under the arms of the user to insure that it remains in place during use. The head and shoulder cover may also be worn by the user while outside of the sleeping system.

BRIEF DESCRIPTION OF THE DRAWINGS

So that the manner in which the above recited features, advantages and objects of the present invention as well as others which will become apparent are attained and can be understood in detail, more particular description of the invention briefly summarized above may be had by reference to the embodiment thereof which is illustrated in the appended drawings, which drawings form a part of this specification.

It is to be noted, however, that the appended drawings illustrate only a typical embodiment of this invention and are therefore not to be considered limiting of its scope for the invention may admit to other equally effective embodiments.

Figure 3:
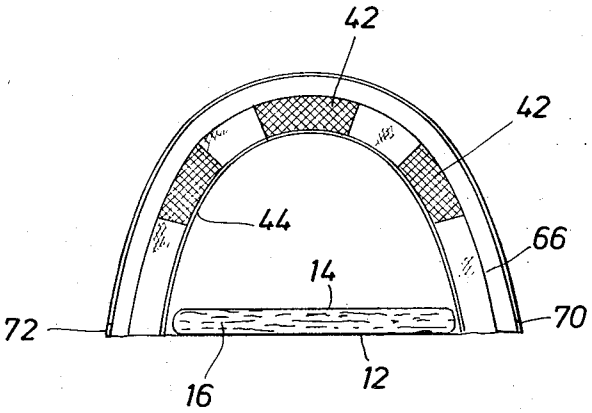
Figure 1:
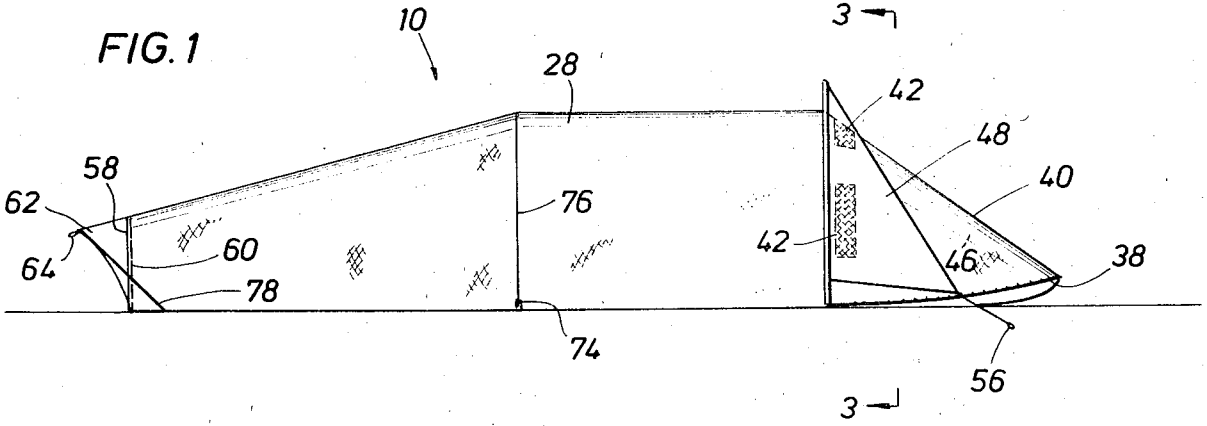

IN THE DRAWINGS:

FIG. 1 is an elevational view of a self supporting portable sleeping system construted in accordance with the present invention.

Figure 2:
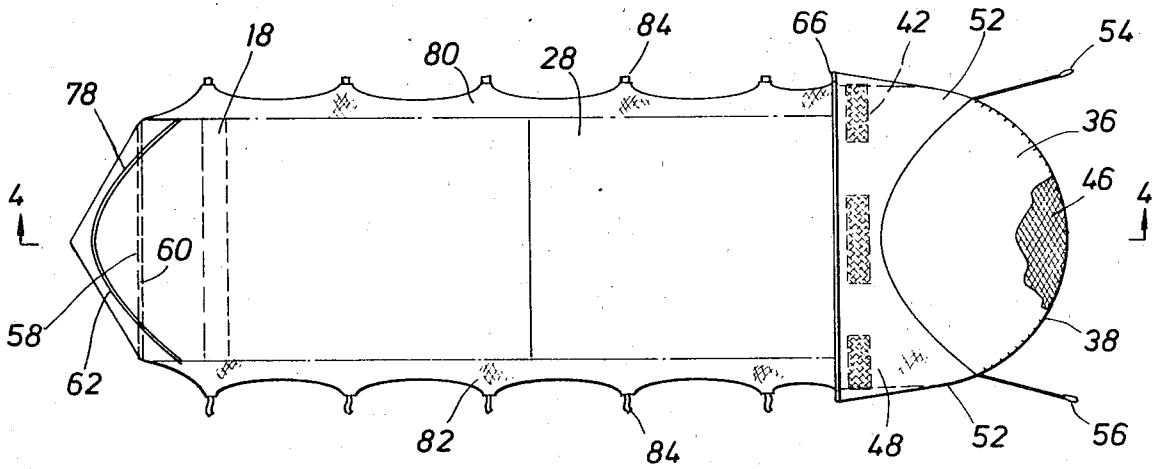

FIG. 2 is a plan view of the sleeping system of FIG. 1.

FIG. 3 is a partial sectional view of the sleeping system taken along line 3—3 of FIG. 1.

FIG. 4 is a longitudinal sectional view of the sleeping system taken along line 4—4 of FIG. 2 and showing in broken line the open condition of a side portion thereof to permit ingress and egress by the user while the interior of the sleeping system remains sheltered.

FIG. 5 is a transverse sectional view taken along line 5—5 of FIG. 4 and showing in broken line the open position of a side portion of the sleeping system.

FIG. 6 is a plan view of the sleeping system showing the condition thereof prior to rolling and in broken line, showing that the sleeping system may be rolled with the head portion thereof extended.

FIG. 7 is a side view of the sleeping system of FIG. 6 showing rolling of the sleeping system to a compact form for portability.

FIG. 8 is a bottom view showing the ground cover sheet of the sleeping system prior to rolling and securing thereof by means of straps.

FIG. 9 is a fragmentary sectional view of the sleeping system of FIGS. 1–8 illustrating the structural components thereof in detail.

FIG. 10 is a cut-away plan view of the head portion of the sleeping system of FIGS. 1–9, illustrating the configuration of the head portion of the insulating liner and pillow pocket assembly.

FIG. 11 is a plan view of the lower floor portion of a self supporting sleeping system representing an alternative embodiment of this invention for use by two persons.

FIG. 12 is a pictorial representation of a head and shoulder cover portion of the sleeping system for minimizing body heat loss from the user.

DETAILED DESCRIPTION OF PREFERRED EMBODIMENT

Referring now to the drawings and first to FIG. 1, a portable, self supporting sleeping system is illustrated generally at 10 which is shown in its assembled and upstanding condition such as during use. As shown collectively in FIGS. 1–5, the sleeping system incorporates a ground cover sheet 12 also shown in FIG. 8 which is of generally rectangular form and is composed of a fabric material which is lined with a water impervious sheet material of any suitable character. Since this sleeping system will often be positioned in contact with damp earth, grass, etc., it is important that moisture be prevented from penetrating the ground cover sheet and otherwise transmitted by osmosis through the protective material within the sleeping system. A pocket 14 composed of fabric material is sew or otherwise attached to the ground cover sheet 12 thus forming a receptable receiving a generally rectangular mattress pad or cushion 16 which is formed of lightweight, porous, plastic foam material or formed of any other suitable material or substance. The pocket 14 has a transverse pad opening 18 which is defined by overlapping upper surface portions of the fabric material forming the pocket 14. The opening 18 of the pocket permits the pad 16 to be inserted into the pocket and also permits it to be removed such as for cleaning, drying, etc.

As shown particularly in FIG. 5 and also in the fragmentary sectional view of FIG. 9, a slide fastener strip 20 is sewn to the ground cover sheet 12 and a mating slide fastener strip is secured to the perimeter of a thermal liner 22. The slide fastener strip 20, commonly known as a zipper, enables the thermal liner 22 to be secured to and removed from assembly with the pocket enclosed pad 16. The liner 22 is of sufficiently thermal nature as to protect the user in the environmental temperature that is expected to be encountered. Form warm conditions, the thermal liner 22 may be of lightweight character and for extremely cold conditions the thermal liner may be quite thick having inner and outer layers of fabric 24 and 26 with a suitable thickness of appropriate insulation material disposed therebetween. Under extremely warm conditions, the liner 22 may be unzipped from the secured fastener strip portion 20 so that the user simply rests on the pad 16 and is not covered. Under such circumstances, the liner 22 may be folded and used as stuffing a head supporting pocket in a manner to be described hereinbelow. The thermal liner may also be retained in place by snap fasteners if desired as an alternative to slide fastener attachment.

In order to protect the user from environmental temperature and also to provide protection in the event of rain, the sleeping system of the present invention incorporates a bivy-cover or tent 28 which is secured to the outer periphery of the ground cover sheet 12. As further shown in the enlarged sectional view of FIG. 9, the tent 28 is secured on one side of the pad 16 such as by sewing it directly to the peripheral portion of the ground cover sheet as at seam 30. On the opposite side of the sleeping system the tent 28 is provided with a slide fastener strip 32 having a mating slide fastener strip 34 secured at the opposite peripheral edge of the ground cover sheet. The slide fastener formed by slide fastener strips 32 and 34 extends along the entire length of one side of the sleeping system so as to permit lateral ingress and egress by the user through an opened side while being protected from rain by the tent. As shown in FIGS. 4 and 5 in broken lines with the slide fastener 32-34 opened, or unzipped, the tent 28 will assume the position shown in broken lines since the internal or external flexible ribs of the system will provide the tent with the support in the manner to be described hereinbelow.

The ground cover sheet and sleeping system will form an enlarged head portion as shown in 36 in FIG. 2 which provides a significantly enlarged enclosed portion for the head of the user to thus permit the user to have significant mobility while enclosed within the sleeping system. The enlarged head portion also facilitates protective storage of clothing and equipment of the user. The head portion 36 will be provided with a pair of slide fasteners 38 which extend about the entire periphery of the head portion. A first one of the slide fasteners provides for releasable connection between the ground cover sheet and a head cover tent portion 40. The tent portion 40 is provided with one or more vents 42 which provide ample ventilation about the head of the user as desired. The vents 42 are provided with an internal closure flap 44 which is sewn to one portion of the head cover sheet 40 and is selectively connected by a slide fastener, fabric retainer strips or by any other suitable means to the sheet 40 on the opposite side of the vents 42. Thus, as much of the vents 42 as is desired may be selectively opened by the user depending on the environmental conditions that prevail. Under extremely cold conditions, the vents may be substantially closed, while under warm conditions, the vents may be fully opened. If plural vent openings are employed they may be selectively opened or closed as desired for ventillation and temperature maintenance.

As shown in the partial cutaway portion of FIG. 2, the head portion 36 of the tent may also be provided with an insect excluding vent wall or net 46 which is secured by the second peripheral slide fastener element to the ground cover sheet 12. Thus, the head covering wall portion 40 of the tent may be pulled back over the central portion of the tent thereby exposing the vent wall 46 about the head portion of the tent. Under extremely warm conditions, the entire head portion of the user may therefore be exposed from above to provide cooling, while the net-like wall 46 provides the user with protection from insects.

To prevent rain from entering the vents 42 in the wall structure 40, a rain excluding flap 48 is secured to an arcuate rib support sleeve extending above the tent 28 and provides a spaced rain cover for the vent 42. The cover 48 incorporates a pair of spaced extension portions 50 and 52 having connector loops or elements 54 and 56 provided at the terminal portions thereof. The connector loops 54 and 56 may be connected to the forward lower portion of the tent or ground cover sheet as shown or in the alternative may be secured to stakes, trees, etc., to thereby maintain the cover 48 in taut condition and in spaced relation with the vent 42. Thus, air is allowed to circulate through the vent openings 42 and rain is excluded by the protective flap 48. The rain flap 48 also functions to maintain the tent structure in taut condition and thus is an integral part of the self supporting feature of the sleeping system.

At the opposite extremity of the sleeping system, the tent 28 is provided with a vent wall 58 of arcuate form. This vent wall may be provided with an internal closure 60 which may be selectively closed by the user to provide as little or as much ventilation at the foot portion of the tent as is desired. To prevent rain from entering through the vent wall 58 while the flap 60 is open, the tent is provided with a rain flap 62 of generally triangular form forming an extension of the tent cover. To the central portion of the rain flap 62 is connected a strip member 64 thus enabling the rain flap to be extended and maintained taut by securing the strap 64 to a stake, tree, etc. An internal or external flexible rib is intended to support the foot portion of the tent and to support the rain flap in extended taut manner.

To maintain the tent 28 in spaced relation with the user throughout the length of the tent if desired, the tent is provided with a plurality of internal or external flexible rib supports. For portability, each of the flexible supports may be provided by flexible fiberglass rods having several sections connected by ferrules. The ribs may be composed of material other than fiberglass if desired. The flexible rods are connected to suitable length and are bent to an arcuate form, with the end portions thereof being received within pockets. The flexible ribs thus provide support for the tent 28 to maintain it in erect taut condition. As shown in FIG. 3, the rib 66 is external, being connected in supporting relation with the tent 28 in any suitable manner. For example, the tent may be provided with a radially extending arcuate peripheral pocket or sleeve which receives the flexible rib as shown in FIG. 3 with terminal receptacles being provided at 70 and 72 which receive and stabilize the end portions of the rib. In the alternative, the ribs may be supported by a plurality of support loops connected in spaced relation about the tent as desired. As shown in FIGS. 1 and 2, the central portion of the tent is supported by means of an internal rib which is also formed by elongated flexible fibreglass rod members secured together by means of ferrules. Internal pockets 74 secured to the tent wall receive the terminal extremities of the internal rib. When the lateral slide fastener along the side portion of the sleeping system is opened or unzipped, the internal rib 76 will unflex to a certain extent thereby forcing the cover 28 to the rain protecting user access position shown in broken line in FIGS. 4 and 5.

It should be borne in mind that the sleeping system may be utilized with only the head cover portion of the tent maintained in spaced relation with the head of the user such as by means of the external rib 66. The intermediate rib 76 and the inclined rib 78 at the foot portion of the sleeping system may be absent thereby allowing the tent to rest on the body of the user below the shoulder level. Ordinarily, when contact between a tent and any interior structure is made, including contact between the user and the tent, the tent will lose its water repellent characteristics thereby allowing moisture to be transferred through the tent. Ordinarily therefore, it is not desirable to allow a tent to settle onto the body of the user because of this moisture transfer problem. The material from which the tent 28 is composed, however, is of three-ply character having an outer fabric composed of a material such as lightweight nylon for example, having an inner layer of material rendering the outer fabric water repellent. It has been determined that an inner backing material for the outer fabric of the tent may be composed of a material sold by W. L. Gore and Associates of Elkton, Maryland, under the registered trademark GORTEX. The tent is further provided with an inner layer of soft moisture absorbent material which has the characteristic of wicking away moisture from the body of the user such as by osmosis. One suitable material for the inner moisture absorbent layer of the tent 28 may be composed of a suitable backing material such as that sold by W. L. Gore and Associates under the registered trademark TRICOT. With the tent 28 resting on the body of the user or on a liner covering the body of the user, any moisture that is present is absorbed by the inner backing maertial of the tent. In each case, the outer fabric layer, the waterproofing layer and the moisture absorbent layer of the tent comprise a "breathable" and waterproof material to thus permit air transfer through the tent. The tent therefore permits air transfer, prohibits moisture transfer and absorbs moisture that might be present within the tent such as from condensation. Tests have shown that the sleeping system is quite effective and comfortable either when positioned in erect manner as shown in FIGS. 1 and 2, or when resting on the body of the user.

Referring now to FIGS. 6, 7 and 8, it is desirable that the self supporting outdoor sleeping system be capable of being reduced to a small, compact configuration for portability. As shown in FIG. 6, the sleeping system 10 in provided with a pair of lateral compression sheet members 80 and 82 which are sewn to the edge portions of the ground cover sheet 12. Each of the sheets 80 and 82 form scalloped edges such as shown at 84 which form connecting members for compression straps 86. The compression straps are adjustable in length and are provided with buckles 88 to thus provide for simple and efficient connection of the compression straps to the connecting members. When the sleeping system is to be reduced in size for backpacking for example, lateral sheets 80 and 82 are folded over the top of the collapsed tent 28 and the buckles 88 are secured to appropriate buckle connectors of the connecting members 84. The compression straps 86 may then be adjusted in length to thus secure the sleeping system under desired compression. When the sleeping system is rolled in the manner shown in FIG. 7, the compression straps maintain sufficient lateral force on the lateral sheet members 80 to prevent elongation of the sleeping system roll shown at 90. The sleeping system may be rolled quite tightly therefore, compressing the resilient pad 16 and liner 22 without permitting elongation of the roll 90 beyond the normal width of the sleeping system as shown in FIG. 6. By way of broken lines, the sleeping system may also be rolled with the enlarged head portion thereof extended outwardly rather than being tucked inwardly as shown in full line. To accomplish such closure, the side portions of the enlarged head may be folded along broken fold lines 92 and 94 and the sleeping system is simply rolled in the manner shown in FIG. 7, causing the head portion to form the outer portion of the roll. Also if desired, the head portion 36 may be folded along fold lines 92 and 94 and may be rolled from the opposite extremity to thus form a small roll which may be flattened to merge with the periphery of the larger rolls formed by the body portion of the sleeping system.

Regardless of the manner in which the sleeping system is rolled, the ground cover sheet construction will enable the roll to be completed and secured to prevent inadvertent opening thereof. The finished roll of the sleeping system also presents a durable outer cover that is capable of withstanding significant scuffing as the sleeping system is transported. As shown in FIG. 8, the ground cover sheet 12 is provided with a protective casing panel 96 such as is formed of fabric material having exceptional durability. The fabric casing panel 96 is sewn to the ground cover sheet 12 and thereby provides a portion of the ground cover for the sleeping system. The panel 96 is impervious to moisture to protect the user when the sleeping system is erect and to prevent the sleeping system from becoming wet such as when subjected to inclement conditions. In order to secure the roll 90 of the sleeping system, the protective panel 96 is provided with retainer means such as a plurality of compression straps 98 which are secured at the intermediate portions thereof to the panel such as by appropriate stitching 100. The compression straps 98 are provided with buckles 102 which receive the free extremities 104 of the straps. After the sleeping system has been rolled the free extremities 104 of the straps are passed through the buckle openings and are drawn sufficiently tight to retain the rolled sleeping system in its small compact size. If desired, the free extremities 104 of the compression straps may be provided with buckle connectors such as shown at 106 which have a snap fit, positive connection with the opposite buckle member 108. Here again, the length of the compression straps is adjustable regardless of the type of buckle system employed. As an alternative to compression straps and buckles, any suitable retainer means may be employed. For example, the casing panel may be provided with spaced sections of fabric fastener material such as sold under the trademark VELCRO which is effective to secure the sleeping system in its rolled condition.

FIG. 10 is a plan view having the head portion of the tent cut away or folded over to expose the lower portion of the sleeping system. The ground cover sheet 12 is provided with an enlarged head portion 110 with an arcuate pocket sheet 112 connected by stitching to the ground cover sheet. The pocket sheet 112 includes an edge 114 which is formed by an elastic member which is stitched to or enclosed within an overlapped portion of the fabric sheet 112. The fabric 112 thus defines a pocket which may be stuffed with items of clothing, spare liners or other soft objects to form a pillow on which the head of the user may rest for personal comfort. At the arcuate edge of the pillow, a draft tube 116 is provided which minimizes air leakage through either of the slide fasteners 38 which secure the head portion 36 of the tent and the insect excluding vent panel 46 to the head portion 110 of the ground cover sheet. The open edge of the pocket sheet may incorporate elastic material or a drawstring to enable it to retain the pillow stuffing.

As further shown in FIG. 10, another feature which promotes the comfort of the user comprises spaced extensions 118 and 120 of the thermal liner 16. The extensions 118 and 120 define a groove or opening 122 therebetween which receives the head and neck portion of the user. The extensions are provided with fabric fastener panels 122 and 124 or other types of connectors which enable the extension portions 118 and 120 of the thermal liner to be secured together and held in a position about the head and neck of the user if desired. This feature provides the user with efficient protection against extreme cold conditions and yet allows the face of the user to be exposed to permit comfortable breathing. To provide further comfort and protection of the user, a thermal strip 126 such as might be composed of a soft, woven polypropylene may be stitched to the liner 116 in the position shown in FIG. 10. When the extensions 118 and 120 are secured together the soft woven strip 126 engages about the neck and head of the user and provides comfort even when the liner is tightly secured about the neck of the user.

As shown in FIG. 11, the sleeping system may also take the form of a double wide sleeping system for use by two persons. FIG. 11 shows the general arrangement of the floor portion of the sleeping system where a ground cover sheet 132 is provided having sheet material 134 and 136 stitched to the gound cover and forming a pair of side-by-side pockets each of which receive resilient pad members in the same manner as discussed above in connection with FIGS. 1–10. The pocket forming sheets 134 and 136 are provided with overlapping sheet portions as at 138 and 140 to allow access to the pockets permitting insertion and removal of the pad members from the pockets. For portability, one or both of the pad members may be removed from the respective pockets and may be carried by one person while the ground cover, tent and liners may be folded and rolled into a compact roll only slightly larger than that developed when a single user type sleeping system is rolled. Prior to rolling, the sleeping system 130 is folded lengthwise along a central fold line 142 to thus expose the longitudinal panel shown in broken line at 144. Thereafter, longitudinal panels 144 and 146 are folded over the sleeping system in the same manner as shown at 80 and 82 in FIG. 6, after which compression straps may be secured in the manner shown in FIG. 6. Here again, the head portion 148 of the sleeping system may be tucked inwardly in the manner shown in full line at 36 in FIG. 6 or may be extended as shown in broken line in FIG. 6, being folded along the lateral edges thereof. When two persons employ a double wide sleeping system as shown in FIG. 11 there resilient protective pad may conveniently take the form shown in the inventor's prior U.S. Pat. No. 4,329,747. In this case, one person could transport a pad removed from the pad pocket after rolling it to a cylindrical form and securing them by means of the retention straps thereof. That person would also transport one of the thermal liners in rolled condition in a separate stuff sack. The other person could then transport the folded and rolled sleeping system with one pad and a thermal liner rolled therein. In this manner, the weight and bulk of the sleeping system is distributed to the two users. The difference in weight can be made up by other equipment being transported by users. In double wide sleeping systems the thermal liners are capable of being zipped together to form a sincle protective thermal liner to cover both persons. The peripheral edges of the double wide liner is connected by slide fasteners to the ground cover sheet in the manner mentioned above.

To provide for further protection of the head portion of the user in circumstances where extremely cold conditions are encountered, the sleeping system may incorporate a head cover device such as generally shown at 150 in FIG. 12. It is well known that a large amount of the body heat of one subjected to cold conditions is lost through the head. Ordinarily, while sleeping in outdoor conditions, the head of the user is uncovered or inadequately protected thus permitting excessive loss of body heat to occur. For this reason, a head cover 150 is provided having a cap portion 152 which is composed of double layers of moisture resistant lined or unlined fabric having a thick layer of heat insulating material disposed therebetween. The cap 152 is provided with a rear portion 154 which extends about the neck and upper shoulder portion of the user. This feature keeps the rear portion of the head and neck of the user warm and comfortable even under extremely cold conditions. A shoulder cover portion 165 is connected to the rear portion 154 and covers the shoulders and upper back and chest of the user. The head cover is also provided with a pair of forwardly extending panels 156 and 158 having fabric fastening panels 160 and 162 secured thereto. The panels 156 and 158 are brought into overlapping relation about the face of the user, below the nose and are secured in place by bringing the fabric panels into interlocking assembly. The fabric panels may conveniently take the form presently sold under the registered trademark VELCRO.

A pair of strap members 164 and 166 are secured at each extremity thereof to the shoulder cover 165. These straps may be formed of elastic strap material and extend under the arms of the user. This feature permits the head cover to be retained in proper assembly relative to the user while worn about the head. The straps also permit the head cover to be removed from the head and placed in resting position on the back of the user near the shoulders. In this manner the head cover is simply supported by the straps 164 and 166 and is available for ready positioning on the head of the user as needed. While not being used the head cover may be placed within the pocket or pockets of the head portion of the tent and used as pillow stuffing in the manner discussed above. It may also be worn while outside of the sleeping system as added protection against loss of body heat in cold conditions.

In view of the foregoing, it is apparent that I have provided a novel lightweight portable self supporting sleeping system which provides efficient protection against moisture transfer from the ground, from the interior of the tent or through use in rainy conditions. The weight of the lower portion of the sleeping system and the weight of the user assists in maintaining the taut, self supported condition of the tent cover by providing downwardly directed forces on the tent cover in opposition to the upwardly directed forces imparted by the flexible support ribs. The sleeping system may be effectively utilized by one or two persons depending upon the character thereof and is supported by a plurality of flexible internal or external rib elements which maintan the tent in erect, spaced relation with the body of the user. The slide fastener arrangement securing one side of the tent to the ground cover permits the tent to be opened along one side thereof for ingress and egress by the user while the tent protects the user such as during rainy conditions, keeping the sleeping system from becoming exposed to rain while being entered or exited by the user. The sleeping system is provided with multiple flaps which may be selectively utilized for efficient control of ventilation thereby provided a system that may be utilized in a wide variety of environmental temperature conditions. For portability, the sleeping system may be efficiently rolled to a small compact size, the length of the resulting rolled sleeping system being controlled by a plurality of compression straps. The ground cover sheet or panel of the sleeping system is impervious to moisture transfer from the earth. It is also provided with a protective panel and compression straps enabling the rolled sleeping bag to be positively secured in rolled condition. The ground cover sheet is also provided with a protective panel which forms the outer fabric of the rolled sleeping system and thus protects it from damage while being transported. The water impervious character of the ground cover sheet and protective panel and the lightweight nature of the sleeping system will permit it to float in the event a rolled sleeping system is inadvertenly dropped into water.

To provide efficient protection in the event of extremely cold conditions the thermal liner of the sleeping system has extension portions which are capable of being secured about the head and neck portion of the user. Further, a head cover of portable nature is also provided to ensure against loss of heat from the head of the user during extremely cold environmental conditions.

It is therefore seen that this invention is one well adapted to attain all of the objects and advantages hereinabove set forth together with other advantages which will become obvious and inherent from a description of the apparatus itself. It will be understood that certain combinations and subcombinations are of utility and may be employed without reference to other features and subcombinations. This is contemplated by and is within the scope of the present invention.

As many possible embodiments may be made of this invention without departing from the spirit or scope thereof it is to be understood that all matters hereinabove set forth and shown in the accompanying drawings are to be interpreted as illustrative and not in a limiting sense.

What is claimed is:

1. A self supporting portable sleeping system, comprising:

(a) ground cover sheet means forming a moisture impervious floor;

(b) a tent cover attached to the peripheral edges of said ground cover sheet means, at least one side of said tent cover being releasable from said ground cover sheet means to facilitate ingress and egress of the user, said tent cover defining rib receptacle means at side portions thereof; and (c) a plurality of spaced flexible ribs having end portions thereof releasably received within said rib receptacle means, said spaced flexible ribs supporting said tent cover in spaced relation with said floor and tensioning said tent cover, at least one end of at least an intermediate one of said ribs being received in releasable connection with said tent cover at said releasable side thereof, upon release of said one side of said tent cover from said ground cover sheet said at least one of said ribs unflexing and acting with the tension of said tent cover supporting the intermediate portion of said tent cover in elevated position above said ground cover sheet means forming an opening with said ground cover sheet means, said ground cover sheet means being protected from rain by said elevated intermediate portion of said ten cover for said ingress and egress of the user.

2. A self supporting sleeping system as recited in claim 1, wherein:

slide fastener means releasably secures said tent cover and ground cover sheet in assembly along at least said one side of said sleeping system, said slide fastener means providing said selective release of said ground cover sheet means and said tent cover.

3. A self supporting sleeping system as recited in claim 1, wherein:

(a) lateral sheet means members extend from opposite side edge portions of said ground cover sheet means and along substantially the entire length of said ground cover sheet; and (b) a plurality of compression straps extend from said lateral sheet members in spaced relation along the length thereof and are adjustably connected in a collapsed condition of said tent cover to place the collapsed sleeping system under lateral compression to permit rolling of said sleeping system under both lateral and peripheral compression.

4. A self supporting sleeping system as recited in claim 1, wherein:

pocket means is attached to said ground cover sheet means at the head portion thereof, said pocket means being capable of being stuffed with soft objects to form a pillow for the head of the user.

5. A self supporting sleeping system as recited in claim 4, wherein:

the tension of said tent cover induced thereto by said flexible ribs normally forces at least one end portion of said ground cover sheet means to curve upwardly from the horizontal, the weight of the user and other objects within said at least one end of said sleeping system acting downwardly on said ground cover sheet and through the connection between the ground cover sheet and tent cover forcing said curved end portion downwardly toward the horizontal and thus develops forces increasing the tension of said tent cover.

6. A self supporting sleeping system as recited in claim 1, wherein:

(a) pad pocket means is attached to said ground cover sheet means and forms a pad opening, said pad pocket means covering a major portion of said ground cover sheet means; and (b) resilient protective pad means being positioned within said pad pocket means and capable of being inserted and removed through said pad opening, said sleeping system being rolled for portability with said pad means present within said pad pocket means.

7. A self supporting sleeping system as recited in claim 1, wherein:

(a) said ground cover sheet means forms a generally arcuate head portion;

(b) said tent cover forms an arcuate head portion of arcuate tapered form and being of greater width than the width of said ground cover sheet means, said head portion having releasable connection with the periphery of said head portion of said ground cover sheet means; and (c) insect excluding net means being secured to said tent cover and having releasable connection with said head portion of said ground cover sheet means.

8. A self supporting sleeping system as recited in claim 7, wherein:

a pair of coextensive, side-by-side slide fastener elements separately provide said releasable connection of said head portions of said tent cover and insect excluding net means to said head portion of said ground cover sheet.

9. A self supporting sleeping system as recited in claim 1, wherein:

(a) said tent cover forms a head portion being releasably secured at the periphery thereof to said ground cover sheet means;

(b) a variable vent opening means is formed by said head portion of said tent cover and is selectively opened by the user to provide ventilation to suit the comfort of the user;

(c) arcuate rib support means extends radially from said tent cover and receives one of said flexible rib means; and (d) rain flap means is secured to said arcuate rib support means and is positionable in spaced relation over said variable vent opening means to exclude rain from said variable vent opening means and simultaneously permit ventilation during rain.

10. A self supporting sleeping system as recited in claim 9, wherein:

said rain flap means is selectively attachable to the head portion of said ground cover sheet means for support thereof in spaced, covering relation with said variable vent opening means.

11. A self supporting sleeping system as recited in claim 1, including:

(a) thermal liner means being releasably secured at the side and foot portions thereof to respective side and foot portions of said ground cover sheet means and having a pair of spaced lateral extensions for selective positioning about the head and neck of the user; and (b) fastening means being provided on said lateral extensions of said thermal liner permitting said lateral extensions to be interconnected about the head and neck of the user to provide efficient thermal protection as desired.

12. A self supporting sleeping system as recited in claim 1, wherein:

(a) said ground cover sheet means forms a casing panel of heavy duty protective fabric extending along a portion of the length thereof, said casing panel forming the outer protective fabric cover of said sleeping system upon rolling thereof; and (b) compression strap means being conencted to said casing panel and being securable about said sleeping system after rolling thereof, said compression strap means forming plural retainers for the rolled sleeping system and being adjustable to the dimension of the sleeping system roll formed by the user.

13. A self supporting sleeping system as recited in claim 1, including:

(a) insulating head cover means receivable about the head of the user and providing insulating protection against loss of body heat from the head of the user;

(b) a pair of insulating panels extending forwardly from said head cover means and being attachable about the face of the user; and (c) support strap means extending from said head cover means and forming a pair of loops receiving the arms of the user, said support strap means supporting said head cover means at the back of the user when said head cover means is removed from the head of the user.

14. A self supporting sleeping system as recited in claim 6, wherein:

(a) said ground cover sheet means is of sufficient width for two persons lying in side-by-side relation;

(b) said pad pocket means is defined by a pair of side-by-side pad pockets secured to said ground cover sheet means;

(c) said pad means being a pair of generally rectangular elongated resilient pads being removably received within respective ones of said pad pockets; and (d) said tent cover means providing covering protection for both of said pad pockets.

15. A self supporting sleeping system as recited in claim 14, wherein:

said sleeping system, being folded along a lengthwise centerline to a single wide configuration prior to rolling thereof to a portable cylindrical form.

16. A self supporting sleeping system as recited in claim 15, including:

(a) lateral compression sheet means secured to said ground cover sheet means and being of the substantial width of only one of said pad pockets, said ground cover sheet being folded lengthwise to expose both side edges of said compression sheet means; and (b) a plurality of spaced compression straps extending from side portions of said compression sheet means along the length thereof and being connectable to place said sleeping system under lateral compression prior to rolling thereof.

17. A self supporting portable sleeping system comprising:

(a) a generally rectangular elongated ground cover sheet composed of moisture impervious material, said ground cover sheet having a casing panel of heavy duty protective fabric forming a portion of the surface area thereof;

(b) retainer means being provided on said casing panel and being connectable in the rolled condition of said sleeping system to secure said sleeping system in compact rolled condition;

(c) a fabric tent cover attached to the peripheral edge portions of said ground cover sheet, at lease one side and one end of said fabric tent cover being releasable from said ground cover sheet to facilitate selective lateral ingress and egress of the user, said fabric tent cover forming rib connector means;

(d) a plurality of spaced flexible ribs supporting said fabric tent cover in spaced relation with said ground cover sheet and tensioning said fabric tent cover, at least one end of an intermediate one of said ribs being received in releasable connection with said rib connector means of said fabric tent cover at said releasable side thereof, upon release of said one side of said fabric tent cover from said ground cover sheet, said at least one of said ribs unflexing and acting together with the tension of said fabric tent cover for supporting the intermediate portion of said fabric tent cover in elevated position forming an opening with said ground cover sheet for said ingress and egress of the user, said opening being protected from rain by said intermediate portion of said fabric tent cover;

(e) a pad pocket attached to said ground cover sheet and forming a pad opening;

(f) a resilient compressible pad of sufficient length and width to support the user from the feet to the shoulders being removably disposed within said pad pocket;

(g) pillow pocket means attached to said ground cover sheet at the head portion thereof, said pillow pocket means capable of being stuffed with soft objects to form a pillow for the head of the user; and (h) the tension of said fabric tent cover induced thereto by said flexible ribs normally forcing at least the head portion of said ground cover sheet to an upwardly curved position, the weight of the user and other objects within the sleeping system acting downwardly on said ground cover sheet and through the connection between said ground cover sheet and said fabric tent cover developing downward forces on said fabric tent cover thus increasing the tension of said fabric tent cover.

18. A self supporting portable sleeping system as recited in claim 17, wherein:

(a) said ground cover sheet forms a generally arcuate head portion;

(b) said tent cover forms a tapered arcuate head portion having releasable connection with the periphery of said head portion of said ground cover sheet; and (c) tapered arcuate insect excluding net means being secured to said tent cover and having releasable connection with said head portion of said ground cover sheet, said tapered arcuate head portion of said tent cover capable of being folded over said tent cover to expose said insect excluding net means.

19. A self supporting portable sleeping system as recited in claim 17, wherein:

(a) said head portion of said tent cover is releasably secured at the periphery thereof to said ground cover sheet;

(b) variable vent opening means is formed by said head portion of said tent cover and is selectively opened by the user to provide ventilation to suit the comfort of the user;

(c) arcuate rib support means extends radially from said tent cover and receives one of said flexible rib means; and (d) rain flap means is secured to said tent cover and is positionable in spaced relation over said variable vent opening means to exclude rain from said vent opening means and simultaneously permit ventilation during rain.

20. A self supporting portable sleeping system as recited in claim 17, wherein:

(a) thermal liner means is releasably secured at the side and foot portions thereof to said ground cover sheet and is adapted to cover the body of the user from the feet to the shoulder area, said thermal liner including a pair of spaced extensions receiving the head and neck of the user therebetween; and (b) fastening means is provided on said spaced extensions of said thermal liner permitting said spaced extensions to be interconnected about the head and neck of the user to provide efficient thermal protection as desired.

21. A self supporting portable sleeping system comprising:

(a) a generally rectangular elongated ground cover sheet forming the floor of said sleeping system and being composed of moisture impervious material, said ground cover sheet having a casing panel of heavy duty protective fabric forming a portion of the surface area thereof, said casing panel having a plurality of compression straps connected thereto for encompassing said sleeping system in the rolled state thereof;

(b) an elongated fabric tent cover having head and foot portions and being releasably attached to the peripheral edge portions of said ground cover sheet, at least one side and said head portion of said fabric tent cover being releasable from said ground cover sheet to facilitate selective ingress and egress of the user, said fabric tent cover forming an elongated body portion, said head portion of said fabric tent cover being of wider and higher dimension than said body portion, said tent cover forming an arcuate rib retaining means at said head portion extending radially outwardly from said fabric tent cover at the juncture of said body portion and head portion and forming a plurality of rib connectors in spaced relation along side edge portions thereof;

(c) a plurality of spaced flxible ribs having end portions thereof restrained by said rib connectors, said ribs supporting said fabric tent cover in spaced relation with said floor and tensioning said fabric tent cover, an intermediate one of said flexible ribs being received by said rib retaining means and forcing said head and body portions of said fabric tent cover to upstanding position;

(d) vent means being formed by said head portion of said fabric tent cover and having closure means for selective opening or closing by the user to control ventilation and temperature within said sleeping system;

(e) the tension of said fabric tent cover induced thereto by said flexible ribs normally applying upward force to end and side portions of said ground cover sheet causing upwardly curved positioning thereof, the weight of the user and other objects within the sleeping system acting downwardly on said ground cover sheet and through the connection between the ground cover sheet and fabric tent cover applying downward force to edge portions of said fabric tent cover, thus increasing the tension of said fabric tent cover.

22. A self supporting sleeping system as recited in claim 21, including:

rain cover means extending from said arcuate rib retaining means of said tent cover means and being positionable in vent sheltering spaced relation with said vent means, said rain cover means being selectively connectable to said ground cover sheet at said head portion to assist in maintaining said tent cover in taut self supporting relation and to maintain said rain cover means in taut condition.

23. A self supporting sleeping system as recited in claim 22, wherein:

(a) said tent cover forms rib retainer means extending radially from said tent cover means at the juncture of said head portion and body portion thereof and forms an arcuate periphery; and (b) said rain cover means extends from said outer arcuate periphery of said rib retainer means.

24. A self supporting sleeping system as recited in claim 23, wherein:

said rain cover means forms a pair of spaced extending portions being securable at the extremities thereof to said ground cover sheet.

* * * * *